United States Patent [19]

Kajiura et al.

[11] 3,955,769

[45] May 11, 1976

[54] YARN FEEDING DEVICE FOR KNITTING MACHINES

[75] Inventors: Toshihiro Kajiura, Osaka; Mitsuo Nagai, Settsu; Shin Tsukuma; Akira Mizuno, both of Itami, all of Japan

[73] Assignee: Kanebo, Ltd., Tokyo, Japan

[22] Filed: May 31, 1974

[21] Appl. No.: 474,904

[30] Foreign Application Priority Data

Nov. 2, 1973 Japan ..... 48-126495[U]

[52] U.S. Cl. ..... 242/47.01; 66/132 R

[51] Int. Cl.[2] ..... B65H 51/20

[58] Field of Search ..... 242/47.01–47.13; 66/132 R

[56] References Cited

UNITED STATES PATENTS

| | | | |
|---|---|---|---|
| 2,469,767 | 5/1949 | Hellbach | 242/47.07 |
| 2,936,877 | 5/1960 | Adams et al. | 242/47.09 |
| 3,419,225 | 12/1968 | Rosen | 242/47.12 |
| 3,637,149 | 1/1972 | Frei | 242/47.12 X |
| 3,776,480 | 12/1973 | Lawson | 242/47.01 |
| 3,791,598 | 2/1974 | Vischiani et al. | 242/47.12 |
| 3,796,386 | 3/1974 | Tannert | 242/47.12 |
| 3,822,833 | 7/1974 | Fecker | 242/47.12 |

*Primary Examiner*—Stanley N. Gilreath
*Attorney, Agent, or Firm*—Paul & Paul

[57] ABSTRACT

The present invention is an improved yarn feeding device which continuously forms yarn coils from a yarn package on its conical shaped winding body and then feeds the yarn to knitting machines with low and constant tension. A taper angle of the winding body is optionally adjustable according to the stretchability of the treated yarn for pushing the yarn coils smoothly toward a knitting machine.

4 Claims, 5 Drawing Figures

YARN FEEDING DEVICE FOR KNITTING MACHINES

This invention relates to a yarn feeding device for temporarily reserving a yarn from a yarn package on a winding body and then supplying it along the axial direction of the winding body to a knitting machine.

The unwinding tension of the yarn drawn off from a package inherently fluctuates not only between packages but also within one package. That is, the unwinding tension varies according to the position of the yarn on the package, for example, upper or lower, outer or inner portion of the package. Consequently, it is necessary to use some type of yarn feeding device in order to obtain uniform unwinding tension, which is esepcially important in the case of feeding a yarn to knitting machines.

A yarn feeding device is known from U.S. Pat. No. 3,419,225 which takes a predetermined amount of yarn from a yarn package, and winds the same on its cylindrical body. The yarn can then be supplied from the wound-up coils on the body to the knitting machine in the axial direction of the body. When the wound-up coils decrease to a minimum limit, the yarn is again wound up and stored on the body.

In the use of the above-mentioned device, it is necessary that the wound-up coils be gradually displaced on said body toward the knitting machine by a pushing means, otherwise jerky feeding occurs because of the over-lapping of old and fresh coils. To avoid this drawback, an inclined plate which is fixed to the axis of the winding body and has a wavy motion is usually used for pushing the coils. To help the action of the inclined plate, it is desirable that the body is provided with a conical circumference which becomes narrower going from a bottom to top. The taper angle of the conical body has to be decided by taking into account the properties of the treated yarn. If the taper angle is too small for the treated yarn, the yarn coils on the body cannot easily move toward the knitting machine and are apt to overlap each other. On the other hand, if the taper angle is too large, the yarn coils slide too easily and several coils may be drawn off at one time from the body during feeding, causing an entanglement of the yarn.

Based on studies conducted by the inventors of this invention, it was found that the desirable taper angle range of the winding body closely depends upon the elasticity of the treated yarn. Namely, the higher the elasticity of the yarn is, the larger the taper angle of the winding body is required to be.

Recently, because many kinds of fabrics consisting of several kinds of yarn or of several patterns are fabricated on a knitting machine and many types of yarns are used for obtaining such fabrics, a requirement has arisen for the yarn feeding device to be capable of handling all of the many types of yarns. This invention has been accomplished to satisfy the above-mentioned requirements.

An object of the invention is to provide a yarn feeding device for a knitting machine which can treat yarns of various types by a minor adjustment.

Another object of the invention is to provide a yarn feeding device having a conical winding body whose taper angle is easily adjustable.

Other advantages and characteristics for the invention will be best understood from the following description of specific embodiments when read in connection with the accompanying drawings.

Figure 1:
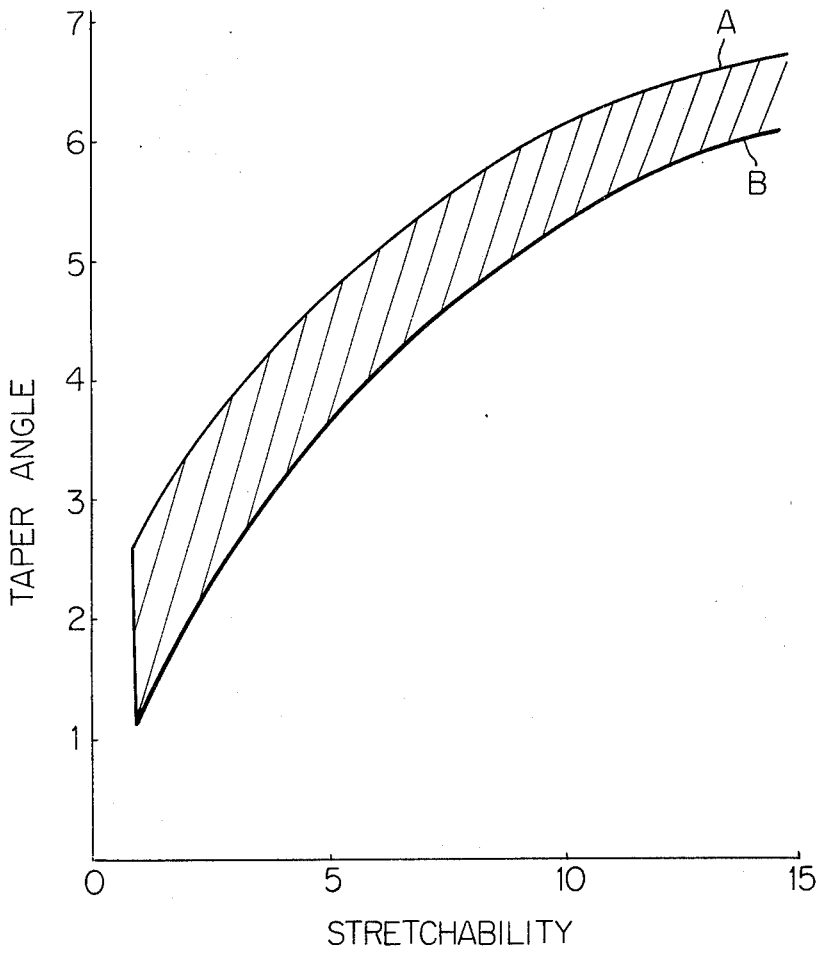
FIG. 1 is a diagram illustrating a preferable taper angle range of the conical winding body of the device according to the invention in relation to stretchability of the yarn treated.

For the sake of easier understanding the present invention, a basic technical idea for creating the present invention is explained in detail before entering into the detailed description of the yarn feeding device according to the present invention. Referring to FIG. 1, the graph was obtained by a following test.

1. Several crimped yarns which had different stretchability, in a range between 1% and 15%, were made from a polyester filament of 75 denier/36 filaments by a known false twisting process.
2. These crimped yarns were fed by a yarn feeding device according to this invention at a rate of 200 m/min, in various taper angles of the winding body of the device stepwisely changed from 1° to 7°.
3. The critical conditions under which unwinding tension was stable and drop-out of the coils did not occur were measured and plotted on the graph, the horizontal axis of which is "stretchability"*1 of the yarn and the vertical axis of which is "taper angles" of the winding body.

*1 Stretchability of the yarn is defined by the formula shown below, the values given the symbols therein being determined as follows.

Hanks of 10 turns are prepared from a tested yarn as test pieces.

Firstly, a weight of 5 mg/denier is hung on the hank and then the length $l_1$ of the hank is measured.

Secondly, the weight is removed and a new weight of 200 mg/denier is hung on the yarn and then the elongated length $l_2$ of the hank is measured.

This procedure is applied to 10 test pieces and, then, the average values of $l_1$ and $l_2$ are calculated to obtain $\bar{l}_1$ and $\bar{l}_2$, respectively.

Stretchability of the yarn S is then obtained from the formula.

$$S = \frac{\bar{l}_2 - \bar{l}_1}{\bar{l}_2} \times 100\%$$

In FIG. 1, the area above the curve A shows a zone where the yarn coils slip too easily and several coils may be drawn off at once. On the other hand, the area under the curve B is a zone where the yarn coils are difficult to be pushed forward and overlapping of the coils may occur.

Therefore, only in the oblique lined zone between the curves A and B, can smooth yarn feeding be obtained.

The graph shows that the taper angle of the winding body has to be changed from 1° to 7° according to the variation of the yarn stretchability from 1% to 15%.

Figure 2:
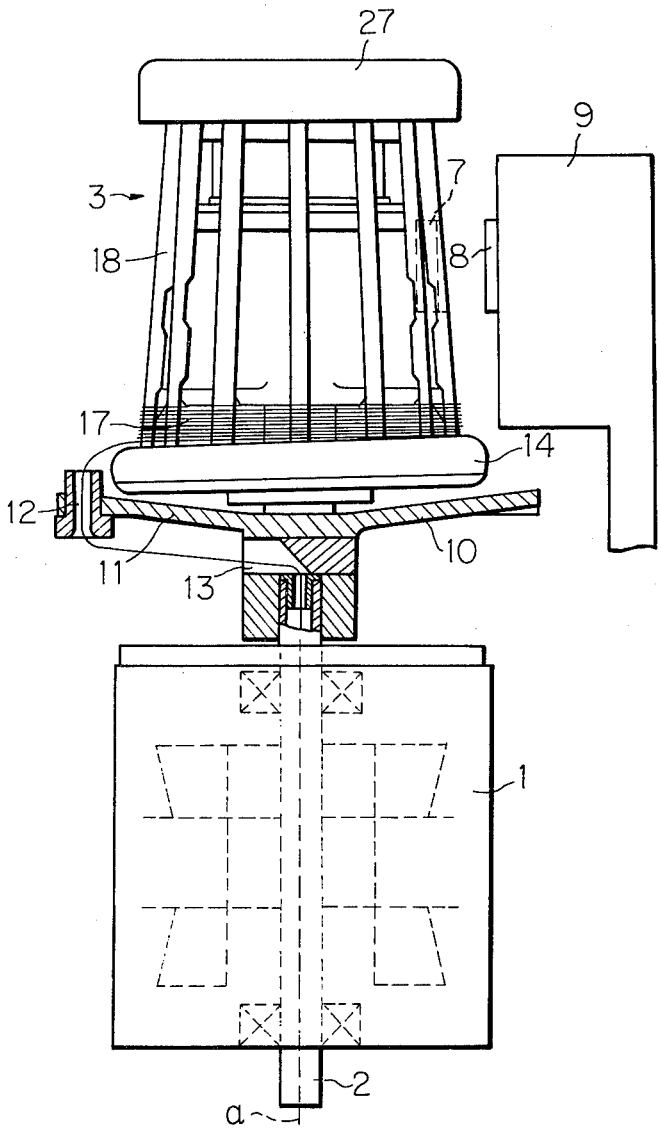
FIG. 2 is a partially sectioned side view of an embodiment according to the invention.
Figure 3:
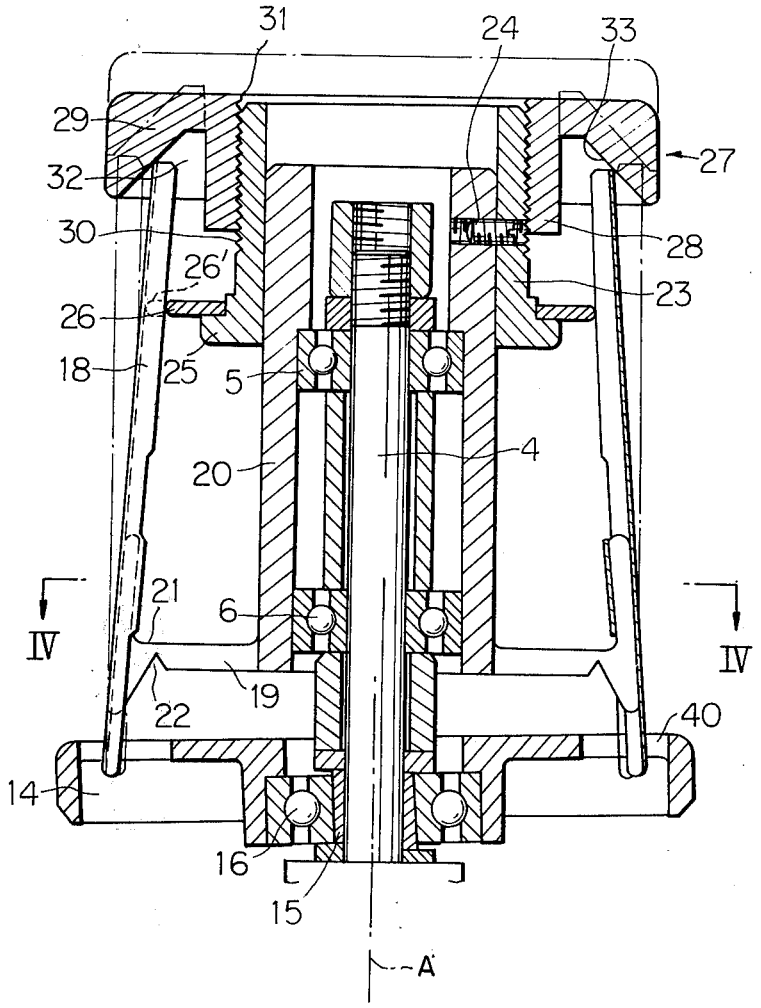
FIG. 3 is a sectional view of the winding body of the embodiment shown in FIG. 2.
Figure 4:
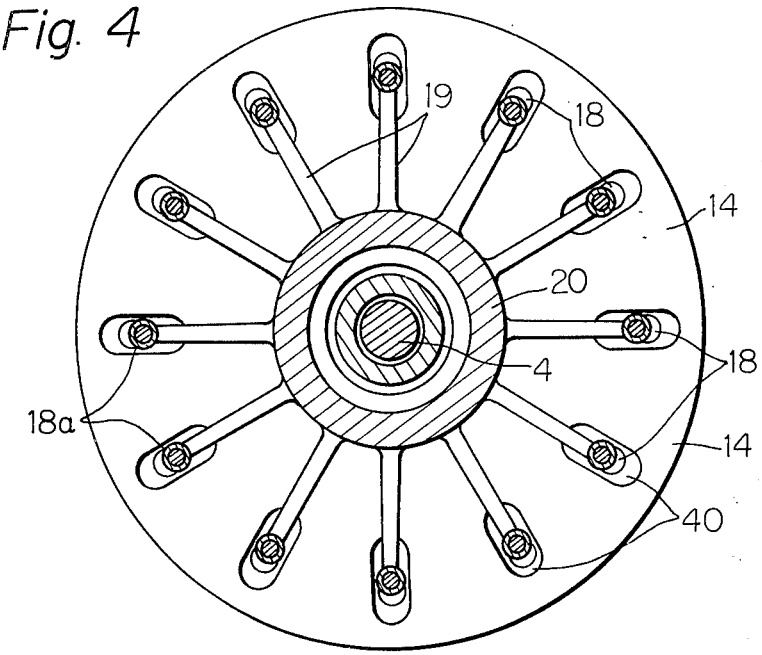
FIG. 4 is a sectional view of the winding body, taking along a line IV—IV in FIG. 3.

FIGS. 2 and 3 and FIG. 4 are embodiments according to the invention.

In FIGS. 2 and 3, a motor 1 is shown which has a rotatable hollow tube 2 as a driven shaft. Above the motor 1, there is a conical winding body 3 which is turnably held on a spindle 4 extending from the hollow tube 2 by way of ball bearings 5, 6. A magnet 7 is secured to an inside surface of the winding body 3 and a magnet 8 having an opposite polarity to that of magnet 7 is secured to an outer surface of a supporting member 9 positioned close to the winding body 3. The magnets 7 and 8 are positioned so that they face each other. Consequently, the winding body 3 is kept stationary by means of the attractive force between the magnets even if the hollow tube 2 rotates. Between the motor 1 and the winding body 3, there exist a flyer 10 which has an arm 11 provided with a guide eye 12 and is secured to the hollow tube 2 at the top thereof. The flyer 10 rotates, with the rotation of the hollow tube 2, close to the outerside of the bottom portion of the winding body 3.

A yarn is a drawn off from a yarn package such as a cone, or a cheese (not shown) in an upward direction and runs into the hollow tube 2 and through a channel 13 at the top thereof, and then through the guide eye 12 of the flyer. When the motor is driven, the hollow tube 2 and the flyer 10 also rotate at the same speed and the yarn a is wound around the winding body 3 because the winding body 3 is held stationary during the rotation of the flyer 10. A disc 14 having a larger diameter than that of the winding body 3 and provided with apertures 40 at positions around circumference thereof, is inclinedly held on the spindle by means of a tapered sleeve 15 and ball bearing 16 in such a way that each aperture 40 is arranged to be loosely engaged with each of bottom ends of bars 18 which are hereinafter described in detail, so as to create a waving motion of the disc 14 about the spindle 4.

The yarn coils 17 freshly wound on the root portion of the winding body 3 are gradually pushed up to the narrow portion of the winding body 3 by the above-mentioned waving motion of the disc 14. Then the yarn coils 17 are unwound successively in an upward axial direction of the winding body 3 and fed to a knitting machine (not shown) in FIG. 3.

The main feature of the device according to the invention resides a construction of the winding body 3 comprising a plurality of bars and a removable cap having a changeable ring. The specific explanation is as follows.

Referring to FIG. 3, the winding body 3 is composed of a plurality of bars 18 arranged to form a substantially conical circumference. Each root of the bars 18 is secured to a equi-radius member such as a rib 19 radially projected from a bottom circumference of a sheath tube 20 used for setting the position of each bars of the winding body 3 on the spindle 4. A thin portion 21 of the rib 19 results from an undercut 22, and due to this thin portion 21 the rib 19 has good flexibility and can resiliently change the angle between the bars 18 and the axis (A). At a top portion of the sheath tube 20 a holder 23 is secured by a set screw 24. The bottom portion of the holder 23 provides a flange 25 for holding a changeable ring 26. The changeable ring 26 can be selected from a set of rings having various diameters and exchanged optionally as hereinlater described.

A cap 27, consisting of a stem 28 and a flange 29 extended from the stem 28, is secured to the top of the holder 23 by thread engagement and the height of the cap 27 is adjustable by means of threads 30, 31 formed on the outer surface of the holder 23 and the inner surface of the cap respectively. An underpart of the flange 29 is a ring shaped groove 32 having a tapered wall 33 inclined inwardly in which the top ends of the bars 18 are engageable. By the use of the cap 27 and the set of changeable rings 26, a winding body having various taper angles is obtainable.

The process to change the taper angle of the winding body is as follows.

First, the cap 27 is removed from the holder 23, and then the changeable ring 26 is changed to a new one 26' which has, for example, a larger diameter. The cap 27 is again set on the holder 23 and screwed in until the top ends of the bars 18 are sliding inwardly on the tapered wall 33 and the bars 18 are caused to touch the circumference of the new ring 26' (shown as a dot line). Thus the bars 18 are held stationary and the required taper angle is obtained.

As the ribs 19 are made of durable plastic such as nylon, polypropylene, etc., they can endure repeated uses.

Figure 5:
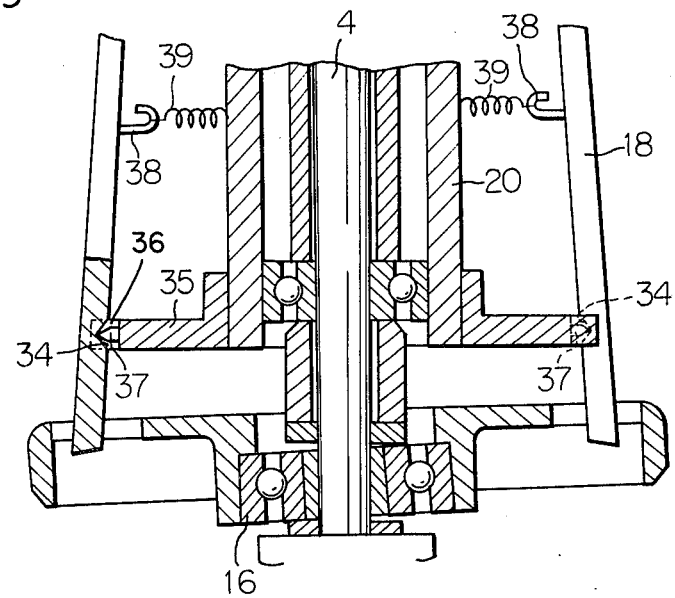
FIG. 5 shows a sectional side view of the winding body of another embodiment.

Of course, in order to change the taper angle, other means may be adopted than the above-mentioned one. For example, as shown in FIG. 5, at a root portion of the bar 18 a small recess 34 is provided. Instead of the ribs 19, a disc 35 is secured to the lower part of the sheath tube 20 and on the circumference of the disc 35 is provided a plurality of recesses 36 formed at circumferential position facing the bars 18. Inside of each recess 36 is a projection 37 which engages with each of the small recesses 34. Each of the bars 18 has a hook 38 secured to an inside surface of the middle portion thereof, through which a spring 39 is set at a tension which does not deform the shape of the winding body.

Several advantages are obtained by means of the present invention among which may be mentioned that the yarn coils on the winding body are moved toward the knitting machine easily and in an orderly manner and fed with a constant and low tension to a knitting machine. Especially, even though a case of small lot size of production, the device according to the invention shows a good adaptability for yarns of various types.

While we have illustrated two embodiments, the invention is not intended to be limited to the details shown, since various modifications and structural changes may be made without departing in any way from the spirit of the invention.

What we claim is:

1. A yarn feeding device for knitting machines comprising a spindle, a mechanism for driving said spindle, a flyer (10) secured to said spindle, a conical shaped winding body (3) mounted on said spindle and disposed at an opposite side of said flyer with respect to said driving mechanism, said flyer (10) being provided with a yarn guide, whereby a yarn from a package is temporarily reserved on said winding body, characterized in that said winding body comprises:

1. a plurality of bars (18) arranged in conical form;

2. a plurality of resilient equi-radius members projecting radially from a locus proximate to the axis of said winding body and pivotally engaging one end of the bars (18);

3. a cap (27) disposed distally upon the spindle, said cap having tapering wall means engaging the opposite ends of said bars (18) from the ends pivotally engaging said equiradius members;

4. a changeable ring (26) adapted to be positioned concentrically of and supported by said spindle, the circumference of said ring providing medial support for said bars;

whereby the lateral displacement of said bars (18) is determined by the diameter of the ring and the relative spatial relationship between said cap (27) and said ring (26).

2. A yarn feeding device for knitting machines as claimed in claim 1, wherein said equi-radius members comprise a plurality of ribs provided with an undercut on their lower surfaces.

3. A yarn feeding device for knitting machines as claimed in claim 1, wherein said equi-radius members comprise a disc provided with a plurality of recesses, within each of which a projection is disposed, and each of said bars is provided with a small recess formed at a position corresponding to each of said recesses in said disc, and spring means for maintaining pivotal engagement of each of said small recesses with each of said projections.

4. A yarn feeding device for knitting machines as claimed in claim 1, wherein said cap is provided with a ring shaped groove (32) having said tapering wall means formed therein coaxially of said spindle, and said cap is adapted to be axially adjustable with respect to said spindle, whereby the conical shape of the winding body is determined by the engagement of said bars with said tapering wall means.

* * * * *